United States Patent [19]

Bullis et al.

[11] Patent Number: 4,571,894

[45] Date of Patent: Feb. 25, 1986

[54] MECHANISM FOR INDEXING WORK SEAL PLATES

[75] Inventors: F. Barton Bullis, South Bend; John T. Pokorski, Osceola, both of Ind.

[73] Assignee: Wheelabrator-Frye, Inc., Mishawaka, Ind.

[21] Appl. No.: 662,496

[22] Filed: Oct. 18, 1984

[51] Int. Cl.[4] ..... B24C 9/00

[52] U.S. Cl. ..... 51/426; 51/417; 51/269; 15/104.04; 118/326; 118/DIG. 7

[58] Field of Search ..... 51/268, 269, 270, 272, 51/412, 417, 418, 419, 420, 426; 15/104.04; 118/326, 634, DIG. 7, DIG. 11

[56] References Cited

U.S. PATENT DOCUMENTS

| | | | |
|---|---|---|---|
| 2,111,782 | 3/1938 | Hudson | 51/270 |
| 2,460,989 | 2/1949 | Kraner | 51/426 |
| 2,893,005 | 7/1959 | Pfaff et al. | 51/269 X |
| 3,031,802 | 5/1962 | Leliaert | 51/426 X |
| 4,326,362 | 4/1982 | Williams et al. | 51/426 X |
| 4,503,577 | 3/1985 | Fowler | 15/104.04 X |

*Primary Examiner*—Robert P. Olszewski
*Attorney, Agent, or Firm*—McDougall, Hersh & Scott

[57] ABSTRACT

An arrangement for positioning selected compliant seals adjacent the inlet and outlet of a work piece treatment chamber. A plurality of variously dimensioned compliant seals corresponding to work pieces of differing sizes are retained on respective inlet and outlet seal carrier members which, in turn, are mounted adjacent the respective treatment chamber openings. Means are provided to permit the movement and indexing of the carrier members such that any one of the compliant seals may be positioned in operative relationship adjacent the treatment chamber. One such means includes circular carrier members mounting for rotational motion on a shaft. The compliant seals being spaced generally around the perimeter of the carrier member and being selectively positioned by the rotation of the member. Alternatively, a linear carrier member mounted for straight-line movement relative to the treatment chamber openings is contemplated.

5 Claims, 5 Drawing Figures

FIG. 2
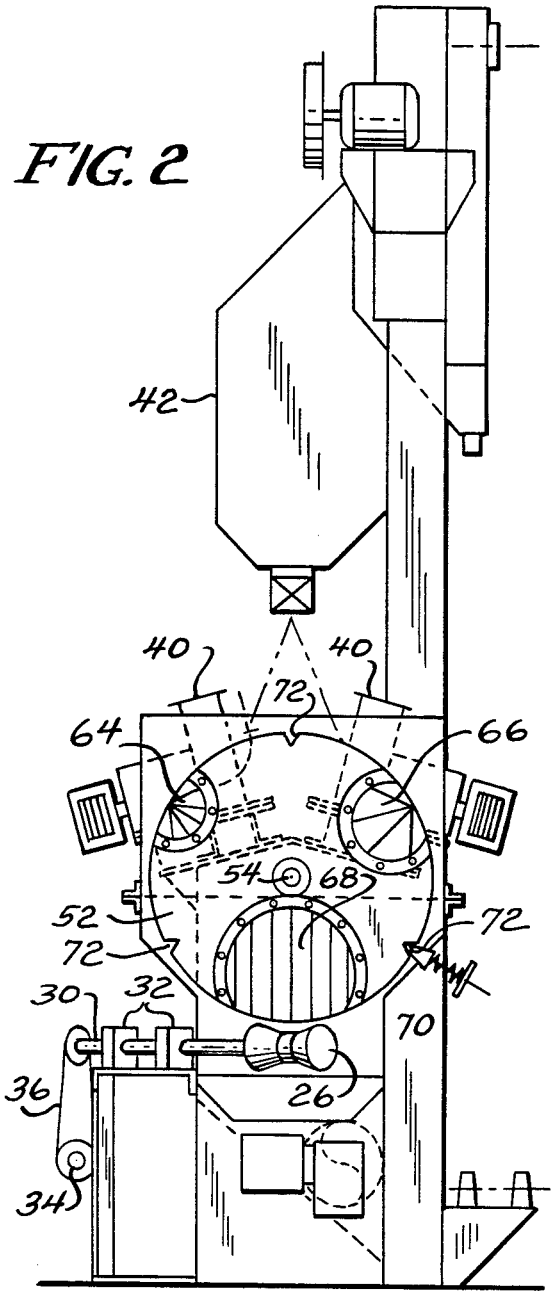
FIG. 3
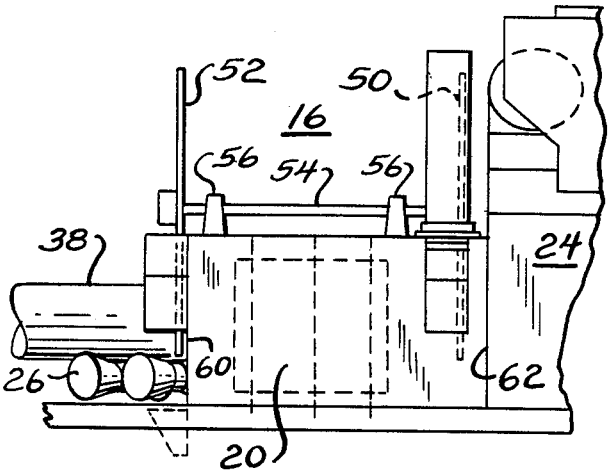
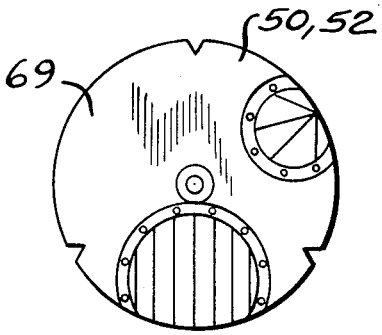
FIG. 4
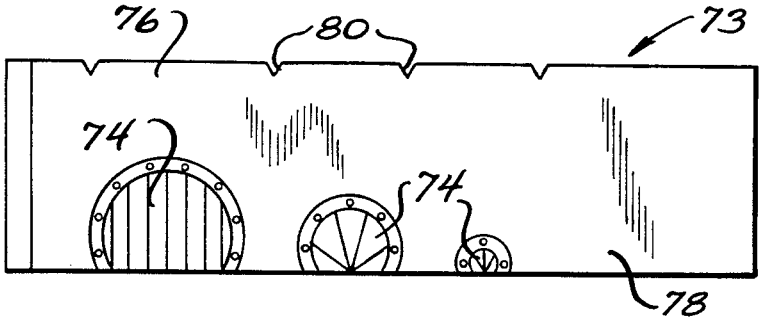
FIG. 5

MECHANISM FOR INDEXING WORK SEAL PLATES

The present invention pertains to seals for protecting the inlet and outlet openings of treatment chambers, for example, a chamber in which abrasive particles of high kinetic energy are projected against work pieces passed therethrough for the surface treatment of these pieces. More particularly, the present invention pertains to an assembly of two or more compliant seals mounted to a carrier member which, in turn, may be indexed relative to the respective treatment chamber openings to facilitate the rapid interchange of compliant seals as required when treating work pieces of differing sizes.

Surface treatment utilizing projected high energy abrasive particles has long been known including, for example, equipment manufactured by the assignee of the present application, Wheelabrator-Frye Inc., Mishawaka, Ind. Such apparatus may be configured to treat either integral, self-contained work pieces of a relatively small size, or, piping, billets, or other elongated stock as a generally continuous process. In the latter example, a conveyor or roll machine receives the elongated work pieces for passage through the treatment chamber at a predetermined rate.

Surface treatment apparatus generally comprises an enclosed compartment or chamber adapted to contain and collect the expended abrasive particulate matter. Inlet and exit openings are provided in the chamber through which the work pieces to be treated pass. However, it will be appreciated that these openings cannot be closed where treatment of elongated work pieces is contemplated as such work pieces necessarily extend beyond and through the respective chamber openings. Thus, to minimize the loss of particulate matter from the chamber, compliant seals are conventionally fitted over the openings, flexing as required to admit passage of the elongated work pieces. More specifically, these seals must be optimized in size and shape, as well as the geometry and cutting details of the compliant material, for the particular cross-section of each elongated work piece to be treated to assure proper sealing action.

Conventionally, an inventory of seals would be maintained with the selected seals manually bolted in position over the chamber openings. To change seals, a plurality of bolts must be removed from both the entrance and exit seals, the newly selected seals substituted for the previously utilized seals, and the bolts repositioned and tightened. Thus, to change operation of the surface treatment machine to an alternate work piece of differing dimension, extensive machine downtime and operator set-up time is required.

The present apparatus is adapted to avoid the above discussed machine set-up times and to rapidly switch operation between differing work pieces by automatically or semi-automatically substituting compliant seals. More specifically, a plurality of compliant seals are rigidly mounted to a carrier member which, in turn, is positioned adjacent a chamber opening such that one of the seals is in operative relationship thereto. Means are provided to index the carrier member thereby positioning alternate seals adjacent the opening.

In a preferred arrangement of the present invention, the carrier member defines a circular disk having a plurality of compliant seals spaced generally around the outer perimeter thereof. The carrier disk is rotably mounted through its center to a shaft whereby the shaft and carrier disk may be indexed to position the desired seal adjacent the chamber opening. In an alternative embodiment, seals are affixed to the carrier member along an axis thereof and the carrier member is, in turn, indexed linearly to position respective seals adjacent the opening. Other carrier member geometries are also contemplated.

It is therefore an object of the present invention to provide in a surface treatment apparatus, or the like, entrance and exit sealing means adapted to permit passage of a plurality of work pieces of differing shapes and cross-sectional dimensions. It is a further object that the sealing means be comprised of a plurality of individual compliant seals. Each of the seals is designed to properly seal a particular work piece. It is an object of the invention that the various seals may be rapidly interchanged to facilitate operation of the treatment apparatus with alternative work pieces and, further, that this interchange be achieved with the minimum of machine down-time and operator set-up time. It is yet another object of the invention that the several compliant seals be rigidly affixed to a carrier member which, in turn, may be indexed to rapidly and effortlessly position another seal in operative relationship adjacent the chamber opening.

These and other objects will become apparent from the accompanying specifications, claims, and drawings including the following figures:

FIG. 2 is a right hand elevation view of the surface treatment system of FIG. 1 showing a seal member having three discrete seals;

FIG. 3 is a front elevation view of the indexed multiple seal apparatus of the present invention;

FIG. 4 is a view of a seal carrier member having a blank seal position therein as viewed looking along the axis of rotation thereof; and, FIG. 5 is a view of an alternative linear seal carrier member for use in the present invention.

DESCRIPTION OF THE PREFERRED EMBODIMENT

Figure 1:
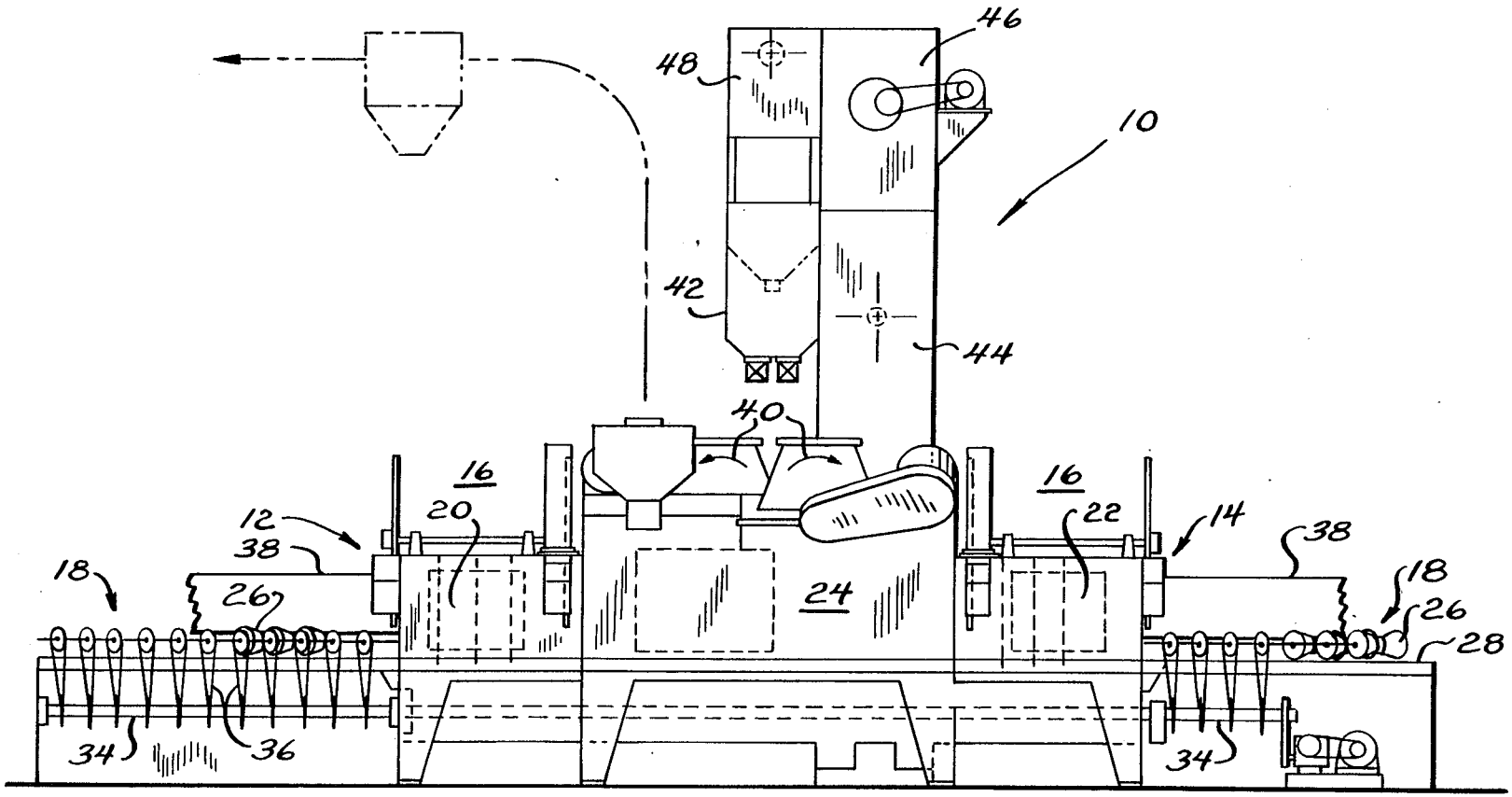
FIG. 1 is a front elevation view of a surface treatment chamber, work piece conveyor, and seal indexing apparatus of the present invention.

FIG. 1 illustrates an abrasive blast surface treatment system 10 incorporating, at both the entrance 12 and exit 14 ends of the treatment chamber, the indexed multiple seal assembly 16 of the present invention. Treatment system 10 comprises a conveyor 18 adapted to properly position and transport work pieces through the treatment chamber which is defined by entrance and exit vestibules 20 and 22 adjacent opposed entrance and exit openings, respectively, of the main blast chamber 24.

Conveyor 18 is comprised of a plurality of rollers 26 spaced laterally along the upper surface 28 of the conveyor. Rollers 26 are supported on shafts 30 (FIG. 2) which, in turn, are rigidly affixed to the upper conveyor surface for rotational movement within bearing assemblies 32. The roller shafts are oriented at a skew angle with respect to the transverse work piece movement axis. Each shaft and roller is powered from a common longitudinal conveyor drive shaft 34 through individual V-belt assemblies 36. The above described skewed roller conveyor is advantageously suited to transport elongated cylindrical piping 38 of varying diameters as well as other similar work pieces. It will be understood that other configurations of conveyors are equally appropriate for use with the present invention depending upon the geometry of the work pieces for which the apparatus is principally intended to operate.

Surface treatment occurs as the work piece, or a portion of the work piece, passes within the main blast chamber 24 wherein a pair of centrifugal blast wheels 40 project, at high energy, abrasive particulate matter against the work piece. Abrasive blast wheels are well known and generally include a hopper 42 for the storage of abrasive shot, a bucket elevator housing 44 and bucket elevator drive 46, and a gravity separator 48 wherein recovered particulate matter is returned to the hopper for reuse.

The indexed multiple seal assembly 16 of the present invention is utilized in conjunction with both the entrance and exit vestibules of the blast chamber. As this apparatus is substantially the same at both chamber ends, it will be considered only in relation to the entrance end 12 of the treatment chamber. FIG. 3 illustrates the entrance vestibule 20 with a yet untreated elongated pipe work piece 38 extending therefrom. The multiple seal assembly 16 comprises circular inner and outer seal carrier plates 50 and 52, respectively, rigidly affixed on a shaft 54 which, in turn, is retained for rotation on the top of the vestibule 20 by a pair of bearing blocks 56. Shaft 54 is aligned generally parallel to the path of work piece travel on conveyor 18 such that respective carrier plates lie in planes transverse to the direction of work piece travel.

Vestibule 20 defines a generally rectangular enclosure bridging a portion of the conveyor, with work piece thereon, adjacent the entrance to the main blast chamber 24. This vestibule functions to contain abrasive blast material which inevitably escapes during surface treatment operations. The work piece 38 enters vestibule 20 through an opening 60 in the leading or front end thereof. A second opening 62 is provided in the wall partitioning vestibule 20 and treatment chamber 24 through which the work piece passes as it enters the latter chamber.

In surface treatment systems adapted to handle a variety of differing sized work pieces, openings 60 and 62 must necessarily be large enough to accommodate work pieces of the greatest contemplated cross-section. Compliant seals are generally fitted to these openings to limit the loss of abrasive particulate material which would otherwise escape between the work piece and the enlarged vestibule openings. A particular seal is designed and adapted to mate or seal with a corresponding work piece of predetermined cross-section. Thus, different seals are required for each of the various work pieces for which the treatment apparatus is to be operated. It will be appreciated that to transition from one work piece to another requires the time-consuming removal and exchange of the several compliant seal members.

By contrast, the present apparatus is adapted to quickly substitute seals as necessary to facilitate surface treatment of a variety of differing size work pieces. More specifically, and referring to FIGS. 2 and 3, seal carrier plates 50 and 52 each carry three separate seals 64, 66, and 68 which are, respectively, adapted for use with work pieces of increasing cross-sectional dimension.

It will be appreciated that the carrier members 50 and 52 may accommodate differing numbers of seals limited only by the size of the individual seals and the overall diameter of the carrier members. Alternatively, as shown in FIG. 4, a blank position 69 may be provided in the carrier member thereby facilitating the total closure of the associated vestibule opening. Such total closure may advantageously be utilized with work pieces of a non-elongated nature which can be positioned entirely within the closed chamber 24 for treatment.

Carrier member 50 is positioned adjacent the entrance end of the treatment chamber and extends downwardly through a lateral slot (not shown) in the top of vestibule 20 such that the carrier member, with seals therein, eclipse or cover the chamber opening 62. In a similar manner carrier member 52 is located adjacent vestibule entrance 60 and extends downwardly thereover. Referring to FIG. 2, carrier member 52 is shown with compliant seal 68 oriented downwardly immediately in front of vestibule opening 60. Thus, seal 68 bridges the gap between the elongated work piece (on rollers 26) and the vestibule opening 60 thereby inhibiting any substantial loss of abrasive material from the vestibule. Sealing member 50 functions in substantially the same manner to minimize to loss of high energy abrasive shot from the treatment chamber through the entrance opening 62 therein.

As illustrated in the Figures, sealing members 50 and 52 are retained on a common shaft 54 for unitary rotation thereon. In this regard, sealing members 50 and 52 are substantially identical, having the same seals therein, and, further, these members are aligned on shaft 54 such that the same respective seals are oriented downwardly and in operative relationship to the vestibule at any given instant. Indexing of the seals is preferably achieved by a tapered or pointed locking member 70 adapted to engage one of a plurality of indentations 72 around the circumference of the carrier member. More specifically, an indentation 72 is provided in spaced relationship to each seal or operative blank position to permit indexing and locking of such seal adjacent the respective vestibule openings. Tapered indexing member 70 is spring-loaded to assure proper indentation engagement and release.

Seal selection may be manual, semi-automatic, or fully automatic. The seal indexing apparatus shown in the Figures is suited for manual operation with a different seal being selected simply by grasping a carrier member and rotating the seal assembly 16 to the desired orientation wherein the indexing member 70 engages the corresponding indentation 72. Alternatively, a motor may be coupled to shaft 54 for either semi or fully automatic operation. In the automatic modes, positioning of the carrier plates may be by servo motors or other conventional control devices.

In some instances it is desirable to separately rotate carrier members 50 and 52, for example, where relatively short, individual work pieces are to be separately treated. In this situation, a first work piece can be treated and completely isolated within chamber 24 by a blank portion of carrier member 50 while carrier member 52 is oriented to admit the next succeeding work piece to the vestibule. For independent carrier member movement, the single shaft 54 is replaced by a pair of shafts individually retained for rotational movement on the top of the vestibule and, further, each carrier member is provided with its own indexing hardware or control.

FIG. 5 illustrates an alternative linear carrier member 73 of the present invention wherein the several compliant seals 74 are spaced side-by-side along the lower edge of a generally rectangular carrier plate 76. A blank or closed seal position 78 is also illustrated. Indexing recesses 80, which function in substantially the same manner as the circular carrier member recesses 72, are provided along the upper edge of linear carrier plate 76. These recesses may alternatively be positioned along the lower edge of the carrier plate.

Linear carrier members 73 are each retained for sliding motion adjacent openings 60 and 62 in respective planes transverse to the direction of work piece travel. More specifically, each carrier member may be moved generally laterally along its longitudinal axis thereby to position the various seals or blank portions of the member in operative relationship with the vestibule opening. It will be appreciated that other configurations are contemplated for the multiple seal carrier members of the present invention.

What is claimed:

1. In a device for the surface treatment of work pieces of differing dimensions, the treatment device having a treatment chamber, means for treating work pieces while in the treatment chamber, said treating means comprising means for bringing abrasive or other surface treatment material into contact with the work pieces, openings in the treatment chamber through which work pieces may pass, means for conveying work pieces into and from the chamber through said openings; the improvement comprising at least one selective apparatus, each of the selective apparatus for sealing one of the treatment chamber openings against loss of treatment material therethrough, said selective apparatus comprising seal carrier means, at least two seal members on the carrier means adapted to admit passage of workpieces of predetermined dimensions and to seal said chamber opening, means for movably retaining the seal carrier means adjacent said chamber opening whereby each of the seal members may be selectively positioned in operative sealing relationship to the chamber opening.

2. The selective treatment chamber sealing apparatus of claim 1 wherein the carrier means defines a substantially circular disk having said seal members spaced generally along the circumference thereof, the disk being mounted substantially at its center for rotational movement whereby the seal members may be selectively positioned in operative sealing relationship to the chamber opening by rotation of the carrier disk.

3. The selective treatment chamber sealing apparatus of claim 1 wherein the sealing members are spaced along an axis of the carrier means; said means for movably retaining the carrier means including means for linearly moving the carrier means along said carrier means axis whereby the seal members may be selectively positioned in operative sealing relationship to the chamber opening.

4. The selective treatment chamber sealing apparatus of claim 1 including means for indexing the seal carrier means whereby each of seal members may be selectively oriented in proper operative relationship to said chamber opening.

5. In a device for the surface treatment of work pieces of differing dimensions, the treatment device having a treatment chamber and at least one vestibule affixed to the treatment chamber, the treatment chamber and vestibule sharing a common wall, the vestibule having a first opening in said common wall and a second opposed opening through which work pieces may pass, means for treating work pieces while in the treatment chamber, the treating means comprising means for bringing abrasive or other surface treatment material into contact with the work pieces, means for conveying work pieces through the vestibule openings into and from the treatment chamber; the improvement comprising selective apparatus for substantially sealing the first and second vestibule openings against passage of treatment material therethrough, said selective apparatus comprising respective first and second seal carrier means, at least two seal members on each of the respective first and second carrier means adapted to admit passage of workpieces of predetermined dimensions and to seal said respective openings, first and second means for movably retaining the respective first and second seal carrier means adjacent the respective vestibule openings whereby each of the respective carrier means seal members may be selectively positioned in operative sealing relationship to the respective vestibule first and second openings.

* * * * *